US006062208A

United States Patent [19]

Seefeldt et al.

[11] Patent Number: 6,062,208

[45] Date of Patent: May 16, 2000

[54] PAINTBALL GUN MONITOR

[76] Inventors: William J. Seefeldt, 167 Jerry Lifert Dr., Monticello, Minn. 55362; John M. Amodrea, 309 Commerce St. P.O. Box 66, Occoquan, Va. 22125

[21] Appl. No.: 09/229,093

[22] Filed: Jan. 11, 1999

[51] Int. Cl.[7] ..... F41B 11/06

[52] U.S. Cl. ..... 124/71; 124/72; 124/73; 124/74; 42/1.02; 42/1.03

[58] Field of Search ..... 124/56, 57, 60, 124/70, 71, 72, 73, 74; 42/1.02, 1.03

[56] References Cited

U.S. PATENT DOCUMENTS

| | | |
|---|---|---|
| 4,876,903 | 10/1989 | Budinger . |
| 4,882,678 | 11/1989 | Hollis et al. . |
| 5,007,817 | 4/1991 | Wallis . |
| 5,137,026 | 8/1992 | Waterson et al. . |
| 5,179,856 | 1/1993 | Huang . |
| 5,736,720 | 4/1998 | Bell et al. . |
| 5,755,634 | 5/1998 | Huang . |

*Primary Examiner*—Michael J. Carone
*Assistant Examiner*—Dan Beitey
*Attorney, Agent, or Firm*—James R. Cwayna

[57] ABSTRACT

The invention and disclosure is directed to improvements for a pressure gun utilized to propel paint containing balls which will, when they strike, break and apply paint to a target or, as utilized in the sport of Paint or Splat Ball, an opposing player, to identify such person as having been hit and therefore out of the game. The improvements include both a retro-fit and a custom adapted monitor with visual readout for counting the number of balls which have been shot by sensing pressure drop, or through Hall effect sensing, or mechanical switch actuation; the latter two sensing propelling bolt movement. The monitor also includes a visual readout for reverse timing to show the player game time remaining and a tank pressure supply readout which will show the player remaining tank pressure. Through microprocessing of the information of shot count and time remaining or elapsed, a shooting rate is determinable. Both the retro-fit unit and the custom unit supply the same basic information to the microprocessor which then will calculate shot rate.

8 Claims, 5 Drawing Sheets

PAINTBALL GUN MONITOR

SPONSORSHIP

This invention has not been made under any Federal nor Independent sponsorship and is the sole result of the efforts of the Applicants.

RELATED APPLICATIONS

Applicants have not filed any previous applications related to the subject matter of this application and are not aware of any applications that may be on file by others which relate to this subject matter.

FIELD OF THE INVENTION

This invention relates generally to guns utilized in the sport of paintball or splatball and more specifically to either a retro-fit or custom fit monitor for such guns which will give a visual readout to the gun user as to the number of shots that have been taken, a timer which is of the reverse variety to time-down and readout the remaining game time and a microprocessor for relating to the user the rate of fire that is being used, whether the gun be arranged for single shot or automatic firing. The monitor also includes a supply tank pressure readout to inform the player of propellant which is available for use.

SHORT SUMMARY OF THE INVENTION

A monitor for a paintball gun which will provide a visual readout to the user of at least the number of shots that have been taken, time remaining in the game being played and a shot rate reading to enable the user to calculate how rapidly the supply of paintball units is being utilized. In addition to these basics, the monitor will include a pressure tank readout to inform the user as to available pressure and thus amount of gas under pressure that remains for use.

One form of the invention includes an interconnection to the pressure supply line of the gun with means for reading the drop in pressure which occurs when a paintball has been fired while another form provides either a Hall effect method of counting the number of times the propelling bolt has been advanced and retracted or a mechanical switch arranged for actuation by movement of the propelling bolt.

The monitor includes a reverse timer which is preset to game time allowed and will, being a reverse timer, provide a visual readout for the remaining time of the game to be played. A microprocessor receives these two information bits and provides a visual shot-rate readout which is important to the user to be aware of how quickly his or her paintball supply will be depleted.

The monitor including its various components and accompanying visual readouts may be mounted integrally with a front gun support as the retro-fit form of the invention or, alternatively may be mounted into the gun body at a convenient and easily visible location. Activation switches are provided to select which readout is desired.

BACKGROUND AND OBJECTS OF THE INVENTION

The sport of paintball or splatball interchangeable terms, is a rapidly growing sport. In this sport, teams of a selected number of persons, attempt to capture a trophy, such as a flag, from the "home" of the opposing team. Persons from one teams will, upon finding an opposing player, fire a fragile, easily broken, paint containing cartridge at this opponent and if this player is hit by such cartridge, they will be marked with paint and be declared "dead" or out of the game. Such games including game times and areas are all pre-established and, obviously, the team that can endure and succeed in capturing the opponents flag with remaining, untainted personnel is the winner.

To date there has been no manner, other than by consulting a dial or wrist watch by which a player can establish what time has lapsed and thus calculate the time remaining in the game. Further, to date, no manner has been provided for the player to determine how fast he or she is shooting and no manner for determining how many shots have been fired.

The paintball gun is supplied with, normally, $CO_2$ under pressure, as the cartridge propellant and the gun is supplied with a load canister into which a number of cartridges are initially stocked with the user normally carrying an additional refill supply.

Therefore the aspects of shot count, game time remaining and shot rate are important to the player. For example, with a high shot rate, the player knows that resupply is necessary within short periods and the provided monitor will give him visual readout as to just how quickly the ammunition is being utilized. Game time remaining is essential for the "battle plans" of the game. Obviously as the game draws to a close, quicker action may be needed.

It is therefore an object of the applicants' invention to provide a visual readout monitor for a paintball gun which will give the user a count of the number of shots that have been fired whether single or automatic shot conditions are in use.

It is a further object of the applicants' invention to provide a visual readout monitor for a paintball gun which will present a game time remaining readout.

It is still a further object of the applicants' invention to provide a monitor having a visuaal readout for use with a paintball gun which will provide, through micrprocessing of information, a shot rate analysis so the user of the gun will be knowledgeable of the rate of paintball ammunition useage.

It is still a further object of the applicants' invention to provide a visual readout for a paintball gun which will provide the user with gas supply tank source information.

In addition to the above, a battery status readout may be provided to assure monitor operation.

These and other objects and advantages will further appear from a consideration of the accompanying disclosure made in association with the provided drawings.

DESCRIPTION OF VARIOUS FORMS OF THE INVENTION

Figure 1:
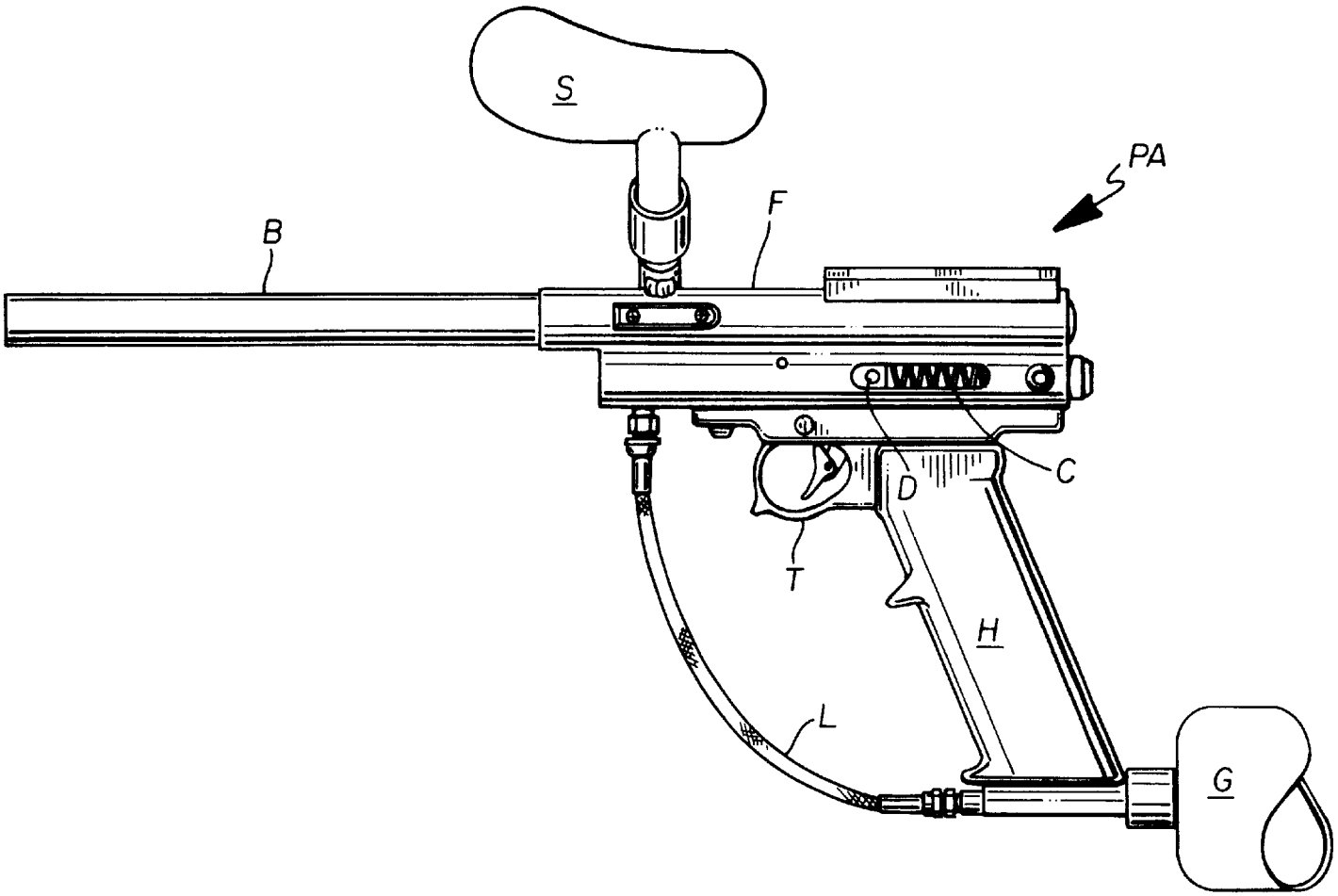
Fig. 1 (PRIOR ART)
FIG. 1 is a side view of a Prior Art Paintball gun illustrating a cartridge supply container and a portion of a gas pressure supply tank.

In accordance with the accompanying drawings a typical, prior art, paintball gun is illustrated in FIG. 1. In this view, the entire gun is designated PA, and includes a framework F, providing a handle H, trigger assembly T and gas supply line L. A barrel B is assembled to the framework F and a cartidge supply S will feed paint containing cartridges to the framework F while gas is supplied to framework F from pressurized gas tank G through line L. A spring loaded, moveable, cartridge propelling bolt C, having a control pin D is also illustrated and, typically, the bolt C is initially moved rearwardly by control pin D against its accompanying spring and thereafter, trigger action and gas pressure will continue to actuate the bolt C for propelling cartridges always returning the bolt to such rear position after a shot. Applicants recognize that these guns may also be set for automatic firing wherein the bolt C is in relatively continual movement.

Figures 2, 3, 4:
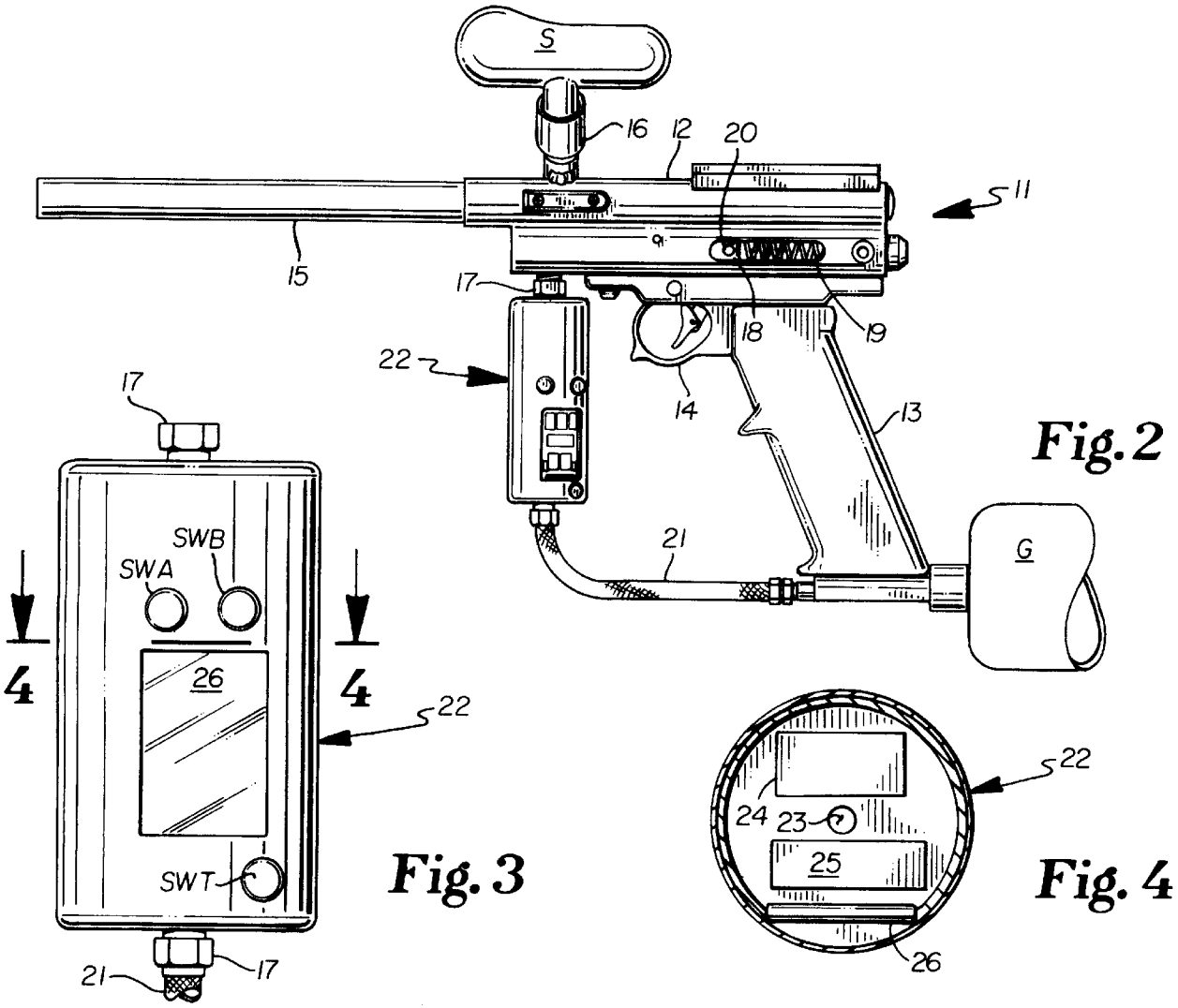
FIG. 2 is side view of a Paintball gun illustrating the concepts of the Applicants' invention for retro-fit of an available gun, again illustrating a cartridge supply container and a portion of a gas pressure supply tank and providing the monitor embodying the concepts of their invention as a front barrel connection.
FIG. 3 is a side view of the monitor, particularly illustrating controls and a covered readout portion of the monitor.
FIG. 4 is a horizontal section taken substantially along Line 4—4 of FIG. 3 illustrating the internal portions of the monitor which include a microprocessor, gas passage line and readout area.

A first form of the invention is illustrated in FIG. 2 wherein the paintball gun is designated, in its entirety, 11 and includes basic modules such as a framework 12, handle 13, trigger guard and assembly 14 and barrel 15. The framework 12 also includes a cartridge supply S, connector 16 and a gas supply G connector 17. A spring opposed, cartridge propelling bolt member 18 is slidably mounted in the framework 12 with the spring designated 19. An outstanding bolt operator extends outwardly from the bolt 18 and is designated 20. When initiating firing, bolt 18 is slid rearwardly against spring 19 by pulling operator 20 rearwardly. Thereafter bolt movement is controlled by trigger actuation and gas pressure acting thereagainst.

Gas; under pressure is fed from supply G through line 21 to monitor 22 and ultimately into the gun through connector 17.

Monitor 22, in the form shown is generally cylindrical in shape to accomodate hand grasping therof and is provided with a gas flow passage 23 longitudinally therethrough. Within monitor 22 is a microprocessor 24 and LCD display module 25 which includess a plurality of LCD readout elements which are selectively controlled by a plurality of switches labelled respecdtively SWA, SWB and SWT. These switches will be more fully explained hereinafter.

The entire readout assembly or display module 25 may be mounted behind a protective, clear shield 26 and it should be stated that monitor 22 may be affixed to the framework 12 in any position to allow user readability thereof.

FIGS. 3 and 4 illustrate a selected form for the monitor 22 and include the selectively operative switches SWA, SWB and SWT. These same switches SWA, SWB and SWT are more fully explained in the description of FIGS. 6, 7 and 8.

Figure 5:
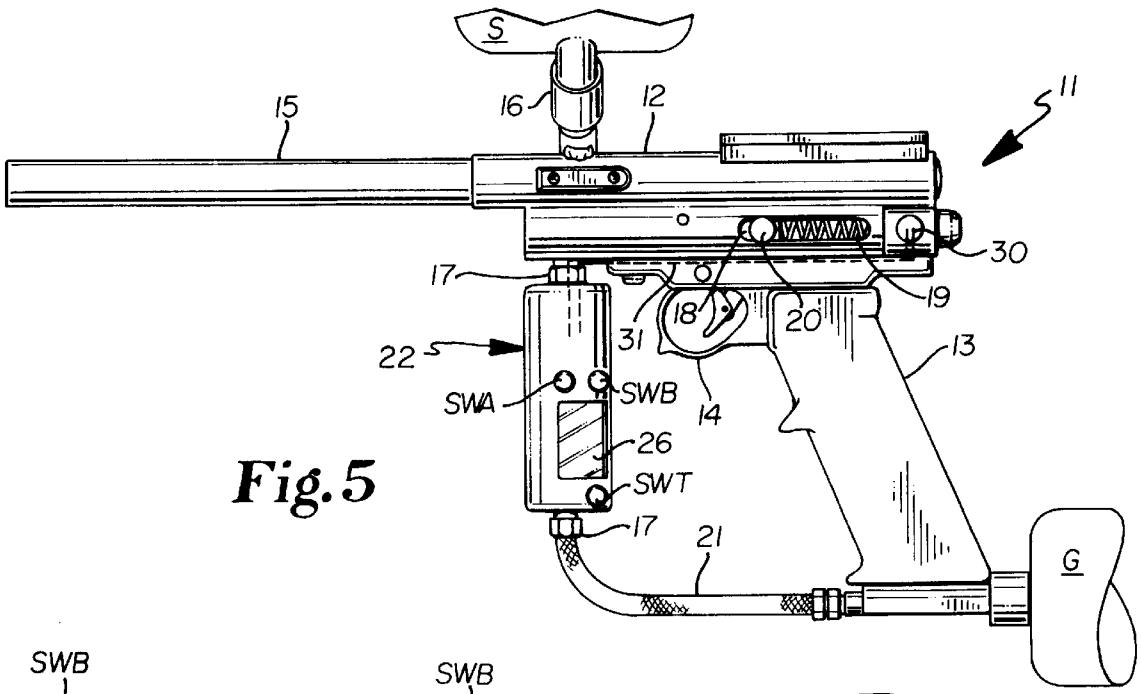
FIG. 5 is a side view of a Paintball gun illustrating the concepts of the Applicants' invention utilizing the retro-fit, front, barrel mounted monitor and arranged to show forms of the invention which provide for Hall effect, bolt movement monitoring or mechanical switch bolt movement monitoring.

FIG. 5 is essentially the same view as FIG. 2 and the same numerals are utilized to designate common pieces and parts and having the inclusion of a magnetically responsive switch 30 in which case a magnet is accomodated on the bolt operating pin 20. This arrangement provides for what is known in the art as a Hall effect signal generation. Proximity of the magnet 20 to the magnetically responsive switch 30 generates a signal. Similarly a mechanical lever switch or the like which is tripped by movement of the bolt 18. may be provided to replace the magnetically responsive=switch 30 without departing from the scope of this portion of the invention which is to sense bolt movement. (The mechanical form of the switchnot being shown.)

This magnetically responsive switch 30 is connected to monitor 22 by conductors 31 which carry a generated signal from either the magnetically responsive chip or witch or the mechanical switch 30.

In either form, a signal is generated which is delivered to the micro processor 24 of monitor 22.

Figure 11:
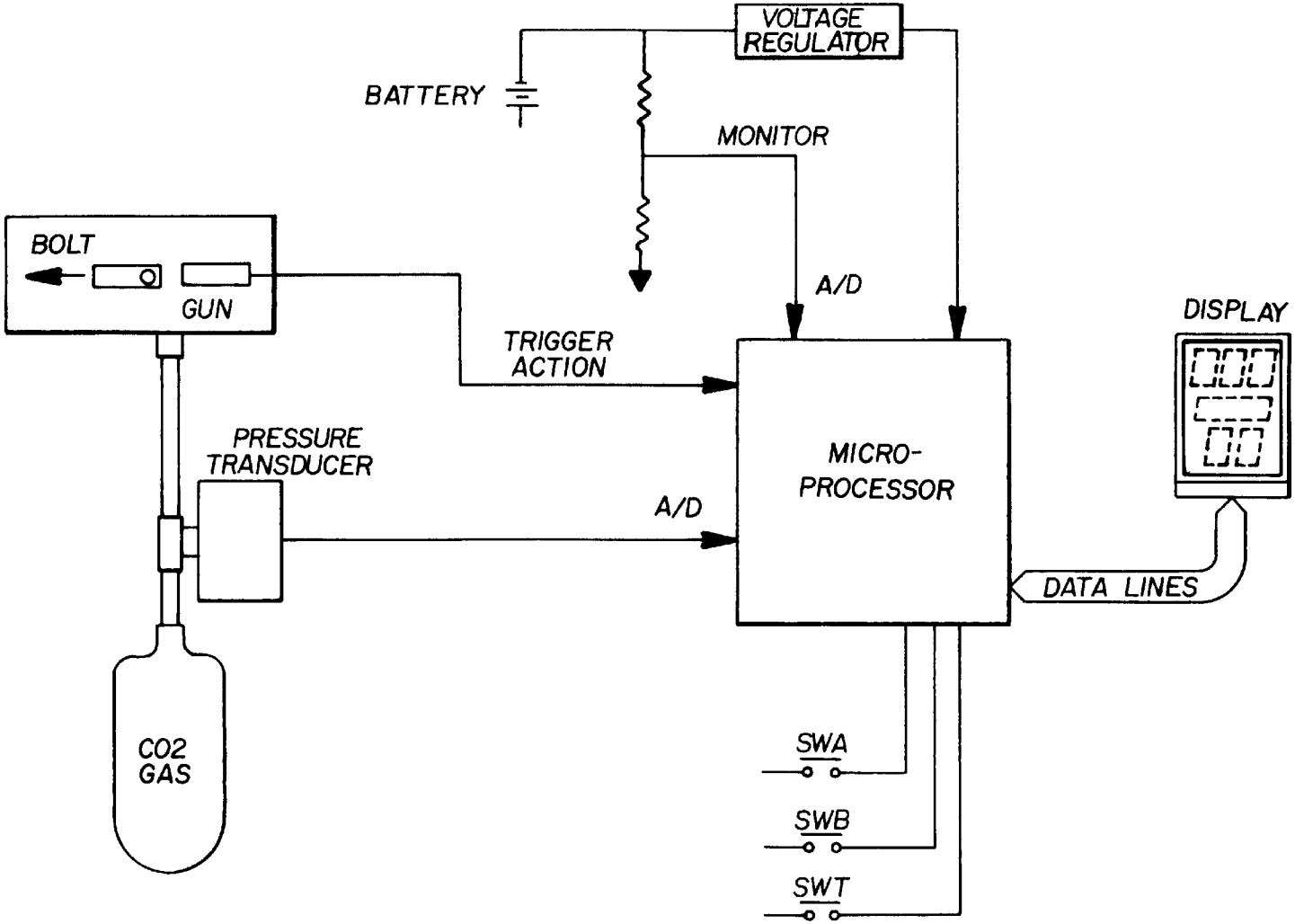

In order to completely explain a first form of the invention but which is designed to sense but is not dependent upon the Hall effect, bolt movement sensing or mechanical switch, bolt movment sensing but relys on pressure drop whenever the trigger is pulled or the bolt is moved to propel a cartridge, it is necessary to consider the schematic illustration of FIG. 11.

This schematic presents two alternative forms which are not in conflict with one another. In the first form, the line designated Trigger Action is not in use when the Pressure Transducer is utilized to determine pressure drops and similarly, the Pressure Transducer is only in use when the Trigger Action or bolt sensing movement is used to determine and relay gas tank supply pressure.

The Pressure Transducer will read both supply tank pressure and will read drops in pressure through the line connecting the gas supply to the gun and therefore through passage 23 of the monitor 22. With each propelling bolt 18 movement, there will be a resultant drop in pressure which is transmitted to the Micro-processor 22 and intermittent therewith will be actual gas supply tank pressure which is similarly transmitted to the Micro-processor. When this operation is utilized, the Trigger Action signal is not required and is not delivered to the Micro-processor. Similarly, when the Trigger action signal is generated, the Pressure Transducer is only operative to provide a tank supply pressure signal.

A power supply including the labelled elements of Battery, Voltage Regulator, monitor power are directed to the Micro-processor for its operation. All signals from the Micro-processor are directed to the Display and the Display LCDs are controlled by the respective switches, SWA, SWB and SWT. SWT should be obvious as this switch will relate to the user the time remaining in the game. SWA or SWB may be selectively elected to control shots counted or shot rate or alternatively, tank pressure readout.

Figure 6:
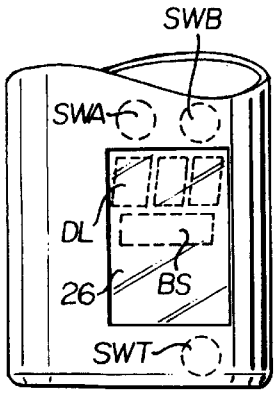

When none of the switches are SWA, SWB or SWT are initiated, a default condition exists and only a shot count is maintained through a visible condition at DL (FIG. 6). This default condition is maintained whether pressure drop sensing, Hall effect readout or mechanical switch bolt sensing movment is utilized.

Basically the Microprocessor receives a signal of either pressure drop in the supply line which is a result of bolt movement or actual bolt movement from the Hall effect sensing arrangement or the mechanical switch sensing arrangement. The Microprocessor maintains this information and makes the same continuously available as shot count, upon default or no SWA, SWB switch actuation.

Figure 7:
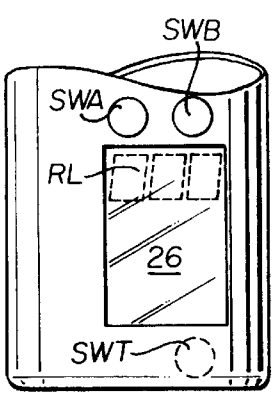

Should switch SWA be activated, the Microprocessor takes into consideration the time lapsed and shot count and calculates the shot rate and makes it available to LCDs designated RL (FIG. 7). Similarly, FIG. 7, should switch SWB be initiated, the LCDs designated RL will a reading of tank supply pressure.

Figure 8:
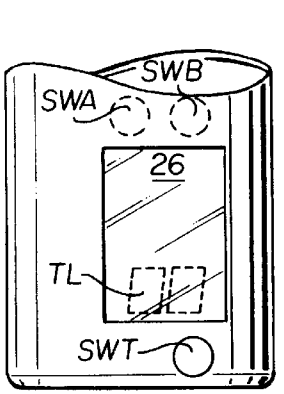
FIG. 6, 7 and 8 are front views of the readout portion of the monitor including the actuation switches when such front, barrel, retro-fit mounting is utilized.

As seen in FIG. 8, upon initiation of switch SWT, another set of LCDs designated TL will give a reading of game time remaining. Obviously this set of LCDs could give an elapsed time reading but this would require the user to calculated the time remaining.

Similarly, in each condition, a battery status readout may be made available through an LCD readout designated BS and though illustrated only in FIG. 6, this may be available for FIGS. 7 and 8.

Figure 9:
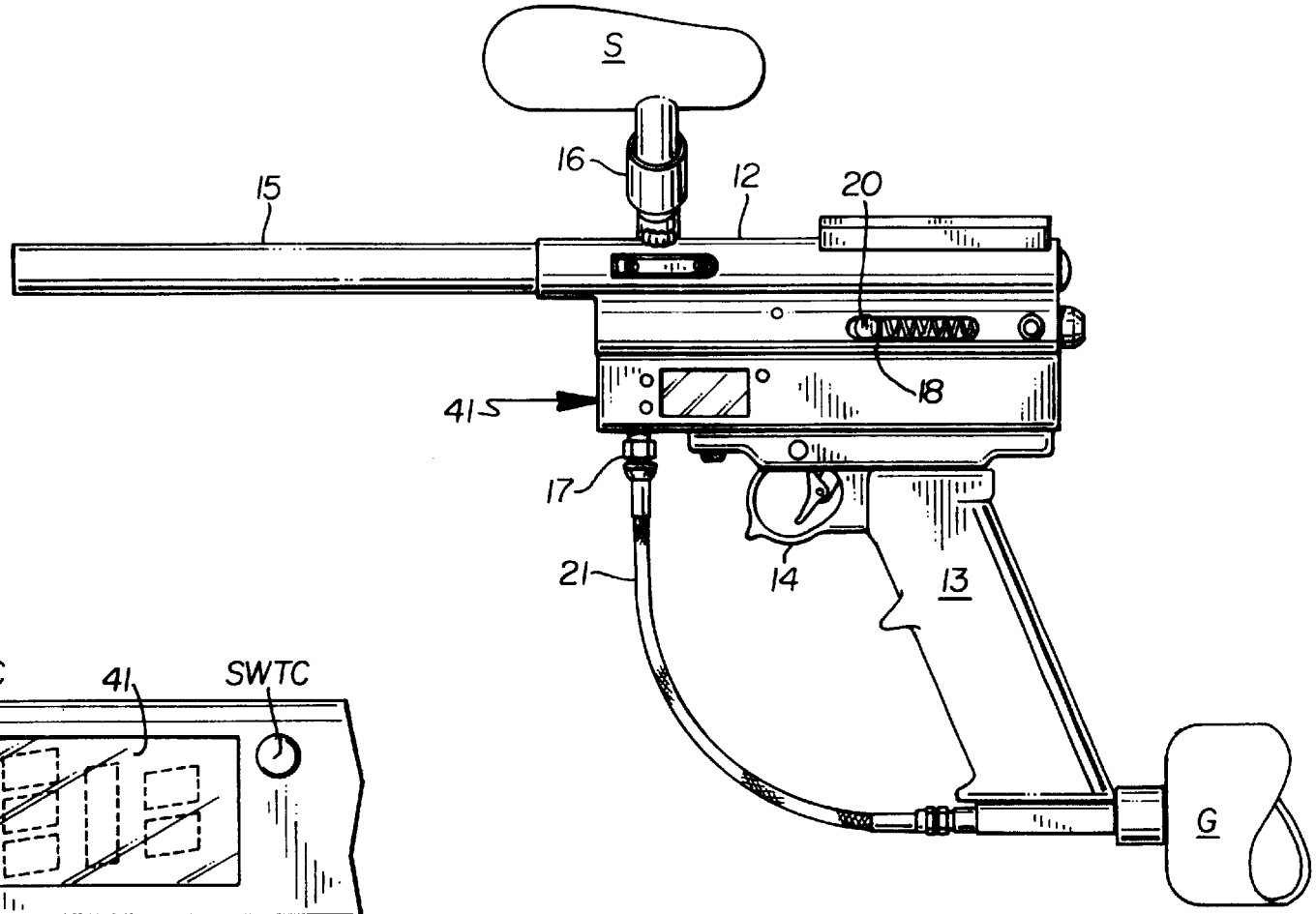
FIG. 9 is a side view of a custom fit monitor arrangement wherein the Hall effect concept or the mechanical switch concept of bolt movement monitoring is maintained and the units of the monitor are mounted within a third, interfit portion of the gun.
Figure 10:
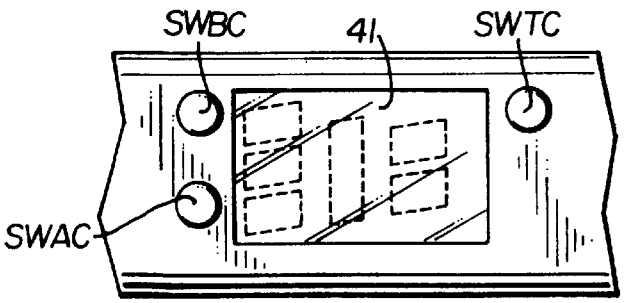
FIG. 10 is an enlarged portion of the monitor readout portion of FIG. 9; and, FIG. 11 is a schematic illustratiing the operating arrangement of the components of the invention.

A modified form of the invention is illustrated in FIGS. 9 and 10. Like numerals, when utilized refer to the same or similar parts between the forms of the invention. In this for the monitor and all of its operative elements are provided into an additional barrel portion designated 41 which is interfit between the handle 13 and trigger assembly 14 and the portion previously indicated as containing the bolt and spring and bolt actuator 20. This barrel portion 41 includes the Hall effect sensing arrangement or the mechanical switch arrangement, neither of which are shown as they are arranged interiorally of such additional barrel and have been described hereinabove. In addition to these bolt movement sensing arrangements, the pressure drop, pressure treansducer, is further incorporated in this barrel portion 41. Selectivity for either pressure drop sensing or bolt movement sensing is incorporated into this custom unit as in the Retro-fit description and again, shot count is always available upon a default or a no switch actuation situation. In this form, the monitor includes the viewable LCD arrangement and the switches which are designated SWAC, SWBC and SWTC as being custom designations. The monitor has been rotated 90 degrees to accomodate fitting thereof into this additional barrel 41.

Again, a supply S is connected to connector 16 and a gas supply tank G is provided to feed propellant to the gun through line 21 and connector 17. In this form of the invention, all elements of the Schematic illustration of FIG. 11 are incorporated into the additional barrel 41 and the operation is identical to that described hereinabove.

The two forms of the invention include all of the same operative elements to allow for either pressure drop or bolt movement count to sustain initial and continuing shot count, time remaining readout and through the Microprocessor analysis, shot rate determination.

The invention then, in either form will and does provide necessary information to the user in a visible and selectable fashion.

What is claimed is:

1. A visual display monitor for a paint ball gun which gun includes a body, at least one barrel, a handle or stock, a trigger, a reciprocating bolt, a gas receiver, a source of gas under pressure arranged to supply gas to the body through the gas receiver and a source of paint bearing, breakable upon impact capsules with means to supply the same to the gun, said monitor including:

a) means for reading the pressure of gas delivered to the gun and responsive to pressure drops occurring when a capsule is fired from the gun and generating a signal upon such pressure drops;

b) at least one user visible LCD readout; and, c) a microprocessor for interpretation of the signal received from said pressure reading means and delivery of the same in readable form to said LCD to provide a readout of the number of pressure drops occurring.

2. The visual display monitor as set forth in claim 1 and switch means controlling delivery of pressure tank drop information to said LCD visible readout.

3. The visual display monitor as set forth in claim 1 and a hand graspable member arranged in close association to said gas receiver, gas from said source arranged to deliver gas thereto and therethrough, said pressure reading means arranged therein and reading the pressure and pressure drops thereof of gas from said source.

4. The structure of the visual display monitor as set forth in claim 1 including:

a) a reverse operating timer settable to a first time and timing reversely therefrom; and, b) a control switch actuatable to provide LCD readout of time remaining.

5. The structure of the visual display monitor as set forth in claim 4 and said microprocessor combining elapsed time from said timer with pressure drop signals whereby a rate of capsule firing is determined and relayed to said LCD.

6. The structure of the visual display monitor as set forth in claim 1, and a) means for sensing source tank pressure, delivering the same to said microproceesor for conversion thereof to LCD readout; and, b) control switch means controlling delivery of said readout to such LCD.

7. The structure of the visual display monitor as set forth in claim 3 and said LCD being mounted on said hand graspable member in user visible position.

8. The structure of the visual display monitor as set forth in claim 5 and said control switch means being multifuntional whereas selected readouts may be elected.

* * * * *